US008366263B2

(12) United States Patent
Schenk et al.

(10) Patent No.: US 8,366,263 B2
(45) Date of Patent: Feb. 5, 2013

(54) INK JET PRINTING METHOD AND APPARATUS FOR COLORING AN ARTICLE OF ALUMINIUM OR ALUMINIUM ALLOYS

(75) Inventors: Hans Schenk, Meggen (CH); Heinrich Mantel, Wädenswil (CH)

(73) Assignee: Mantel Digital, Inc., Laguna Niguel, CA (US)

( * ) Notice: Subject to any disclaimer, the term of this patent is extended or adjusted under 35 U.S.C. 154(b) by 780 days.

(21) Appl. No.: 12/174,256

(22) Filed: Jul. 16, 2008

(65) Prior Publication Data

US 2010/0013879 A1 Jan. 21, 2010

(51) Int. Cl.
*B41J 29/38* (2006.01)
*B41J 2/01* (2006.01)
*B41J 3/407* (2006.01)

(52) U.S. Cl. ..... 347/106; 347/6; 347/9; 347/105

(58) Field of Classification Search ..... None
See application file for complete search history.

(56) References Cited

U.S. PATENT DOCUMENTS

2005/0046680 A1* 3/2005 Cheng et al. ..... 347/74
2005/0078159 A1* 4/2005 Yamazaki et al. ..... 347/101
2007/0126840 A1* 6/2007 Hibbard et al. ..... 347/108

FOREIGN PATENT DOCUMENTS

WO WO 99/29789 6/1999

* cited by examiner

*Primary Examiner* — Matthew Luu
*Assistant Examiner* — Kendrick Liu
(74) *Attorney, Agent, or Firm* — Ostrolenk Faber LLP

(57) ABSTRACT

A printing method and apparatus for coloring an article of aluminum or aluminums alloys, said article comprising a surface formed by an open pore oxide layer, and an article printed therewith.

Figure 1A:
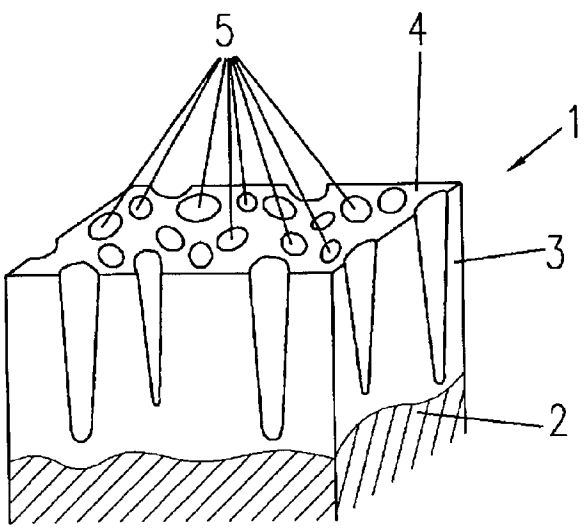
Figure 1B:
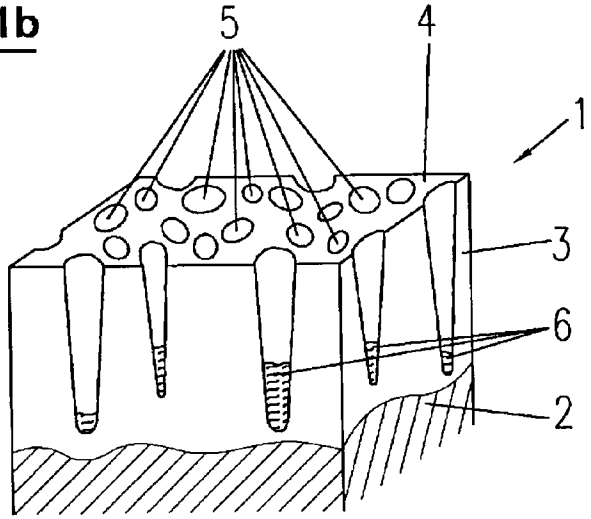
Figure 1C:
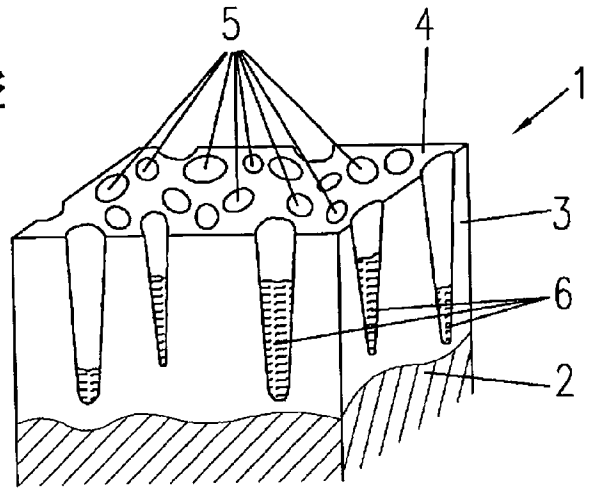
Figure 1D:
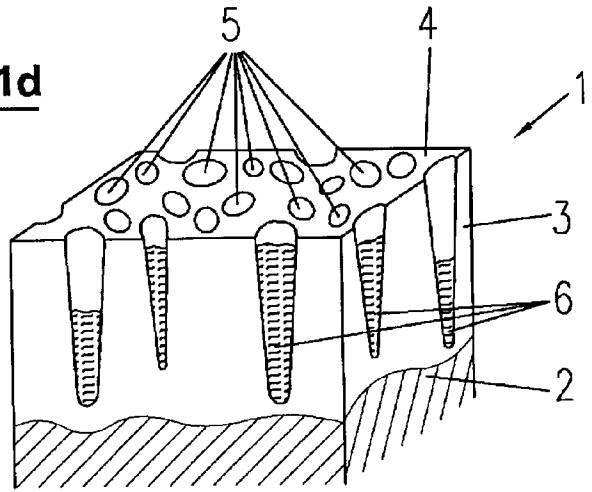

In order to achieve a high quality printing image that exhibits a high resolution, wherein the effects of color migration and bleeding of the deposited ink compositions are reduced, the method comprises the steps of mounting said article on an inkjet printing apparatus;

printing a bottom printing layer on said surface according to predetermined pixel information and at a predetermined ink deposition rate for each pixel;

successively printing at least two upper printing layers on said surface, wherein on each upper printing layer the same pixel information is printed as on the bottom printing layer and the ink deposition rate for each pixel is adjusted if required; and heating said article for fixing the resulting printing image on said surface.

17 Claims, 2 Drawing Sheets

INK JET PRINTING METHOD AND APPARATUS FOR COLORING AN ARTICLE OF ALUMINIUM OR ALUMINIUM ALLOYS

The present invention relates to an ink jet printing method and apparatus and to an article printed therewith. More particularly, the invention relates to the coloring of an article made of aluminium or aluminiums alloys comprising a surface formed by an open pore oxide layer.

Aluminium and aluminium based alloys in a form of a plane shaped article such as plates, sheets, foils and the like are commonly applied for display purposes, e.g. for signs, markings, labels, inscriptions, etc. Various processes are known to produce color effects on the surface of aluminium material, wherein before its coloring the aluminium material is usually subject to an anodic oxidation treatment. Thereby, an adherent open pore oxide layer is formed on the aluminium surface, which is used during the coloring process to absorb the coloring medium.

Typical coloring methods known in the art for aluminium and aluminium alloys comprise photolithographic techniques or screen printing processes for the deposition of dye or pigment inks or organic coloring agents in the open pore oxide layer. During photolitography, the open pore oxide layer is coated with photoresist, which is then exposed to ultraviolet light through a lithographic film, tracing paper or other mask to form a negative image layer. The unexposed areas are then washed of, dried and flooded with dye solution. Then the exposed resist material is dissolved and the whole process may be repeated for subsequent colors. Thereby, a printing image with a high resolution can be achieved, but the large number of time consuming processing steps and the complicated handling and expensiveness of the image processing material are disadvantageous.

In screen printing, the desired image is printed on the anodized surface layer using paste-borne dyes, which then migrate into the open pored surface layer and are fixed therein by means of immersion in boiling water. However, often only one color can be printed at a time and the overall process is quite complicated. Furthermore, only a comparatively low resolution of the printing image can be achieved.

Patent application no. WO-99/29789 addresses above discussed problems associated with prior art printing techniques and discloses a printing method and ink compositions therefor for alleviating at least one of those disadvantages. Each of the proposed ink compositions comprises 3% by weight of each of standard dyes Solvent Yellow 83, Solvent Blue 44 and Solvent Red 127 in a solvent composition comprising 50% by volume of 2-propylene glycol 1-methyl ether and methanol. The proposed printing method comprises loading of these ink compositions into ink cartridges of an ink jet printing machine and printing the desired image on the open pore oxide layer of an aluminium sheet, which then is immersed in boiling water. This way, a relatively high resolution print with a reduced bleeding and migration of the deposited ink or color pigments can be achieved, as compared to conventional screen printing methods. Furthermore, printing of multiple colors at one time is feasible. However, the proposed method involves a high temperature range of the ink of about 300° C. to 350° C. during the printing process, during which the resistance and stability of the applied printing image can not be easily controlled, in particular migration effects of the applied color pigments. The applicant of the present invention has realized that a higher quality of the resulting printing image is still desirable.

Accordingly, it is an object of the present invention to propose a method and apparatus for coloring an article of aluminium or aluminiums alloys, wherein the printing image exhibits a high resolution and wherein the effects of color migration and bleeding of the deposited ink compositions are reduced.

It is another object of the present invention to propose a method and apparatus for coloring an article of aluminium or aluminiums alloys, wherein a printing image resolution of at least 720 to 1440 dpi is feasible.

It is a further object of the present invention to propose a method and apparatus for coloring an article of aluminium or aluminiums alloys, wherein printing is possible at comparatively low processing temperatures (<50° C.), thus providing high controlability and stability of the printing image.

It is yet another object of the present invention to provide a colored article of aluminium or aluminium alloys with a high image quality, which is producible at low cost, even in case of individual single-unit production or small series production.

According to one aspect of the present invention, it has been found that at least one of the foregoing objects is fulfilled by a method for coloring an article of aluminium or aluminiums alloys, wherein said article comprises a surface formed by an open pore oxide layer. The proposed method includes the steps of mounting said article on an inkjet printing apparatus and printing a bottom printing layer on said surface according to predetermined pixel information and at a predetermined ink deposition rate for each pixel. This is followed by successively printing at least two upper printing layers on said surface, wherein on each upper printing layer the same pixel information is printed as on the bottom printing layer and the ink deposition rate for each pixel is adjusted if required, and heating said article for fixing the resulting printing image on said surface.

Thus, the present invention firstly suggests that the printing image is formed by successive deposition of at least three printing layers (a bottom printing layer and two upper printing layers) on said surface according to said predetermined pixel information by means of an inkjet printing apparatus. Secondly, the invention teaches that the ink deposition rate of said inkjet printing apparatus may be varied during deposition of said upper printing layers in order to comply with various processing demands. Preferably, said adjusting of said ink deposition rate is carried out depending on characteristics of at least one of the following: said open pore oxide layer, said predetermined pixel information and ink compositions used in said inkjet printing apparatus.

According to a preferred embodiment said ink deposition rate is adjusted to a decreased value during printing of a number of pixels of at least one of said upper printing layers, with respect to the corresponding pixels of said bottom printing layer. Thus, the effective amount of deposited ink on respective pixels of that upper printing layer is essentially decreased. Thereby, bleeding of the applied ink compositions is effectively avoided and a high quality of the resulting printing image can be accomplished, which provides high resolution and low color migration effects. More preferably, said ink deposition rate is adjusted to a decreased value during printing of said number of pixels of each of said upper printing layers with respect to corresponding pixels of the foregoing printed printing layer, thus reducing the impact of color bleeding effects layer by layer. Said number of pixels for which the ink deposition rate is adjusted may represent a higher color depth as compared to remaining pixels of said predetermined pixel information, since bleeding effects occur more frequently at regions of the printing image which exhibit a higher color depth. During printing of said remaining pixels of each of said upper printing layers said ink deposition rate may be adjusted to the same value with respect to corresponding pixels of said bottom printing layer, since bleeding effects may not occur at the lower color depth corresponding to these pixels.

Preferably, at least five upper printing layers are successively printed for achieving a very high quality of the printing image. Furthermore, said ink deposition rate during printing said number of pixels of the final upper printing layer is preferably decreased by at least 50% as compared to the ink deposition rate during printing of corresponding pixels of the bottom printing layer, in order to effectively reduce the effect of bleeding of the applied image colors.

According to another embodiment, in particular if the ink compositions used in said ink jetting apparatus exhibit a high viscosity or for simplicity reasons, said ink deposition rate is adjusted to the same value with respect to corresponding pixels of said bottom printing layer during printing of each pixel of each of said upper printing layers. Alternatively, said ink deposition rate may be adjusted to an increased value for a number of pixels of at least one upper printing layer with respect to corresponding pixels of said bottom printing layer, in particular if the ink compositions used in said ink jetting apparatus exhibit a very high viscosity. In this manner, a poor diffusion characteristics of deposited ink droplets exhibiting a higher viscosity in said open pore oxide layer may be compensated.

Preferably, said adjusting of said ink deposition rate comprises regulating the number and/or size of ink droplets emitted per pixel from said inkjet printing apparatus during printing of said printing layers.

Preferably, a piezoelectric inkjet printing apparatus is applied. The usage of a piezoelectric inkjet printing apparatus allows exact controlling and adjusting of said ink deposition rate for each pixel on each printing layer. In practice, said adjusting of said ink deposition rate may comprise regulating the piezoelectric force generated during printing of said printing layers in said inkjet printing apparatus.

Preferably, said pixel information may comprise position and/or color and/or color depth, etc. of each pixel point of the printing image to be printed on said surface during printing of each of said printing layers. Preferably, said pixel information does not depend on particular material characteristics, e.g. pore position or pore density of the oxide layer, but only contains information related to said printing image. Said pixel information may be stored in a data processing unit. Preferably, also information corresponding to said ink deposition rate for each pixel point of each of said printing layers is stored in a data processing unit. Said stored information corresponding to said ink deposition rate may depend on characteristics of at least one of the following: said open pore oxide layer, in particular surface roughness and pore depth, said predetermined pixel information and ink compositions used in said inkjet printing apparatus.

Preferably, a constant negative pressure is applied on at least one ink cartridge of said inkjet printing apparatus, in order to prevent undesired leaking out of the ink compositions, in particular during stand-by-mode of the printing head operation, and to avoid printing irregularities for a given ink deposition rate during printing operation of said printing layers. Preferably, said constant negative pressure is at least −11 mbar during printing of said printing layers.

Preferably, said heating of said article is carried out at a temperature of 98° C. (371 K) and during a time segment of 40 to 60 minutes. Furthermore, said heating of said article preferably is carried out by means of demineralized water.

A further aspect of the present invention provides an ink jet printing apparatus for coloring an article of aluminium or aluminiums alloys, said apparatus comprising ink jetting means adapted for successive printing of a number of printing layers on top of each other on a surface of said article, wherein the ink deposition rate of said ink jetting means is adjustable during printing of each pixel of said printing layers. Said apparatus further comprises data processing means adapted for controlling said ink deposition rate on said ink jetting means, wherein information corresponding to said ink deposition rate for each pixel of each of said printing layers is stored in said data processing means. Thus, a high quality of the printing image can be achieved, wherein the ink deposition rate can by varied for each pixel and each printing layer on said ink jetting means according to the information stored in said data processing unit. Preferably, said stored information varies for at least two of said printing layers.

According to a preferred embodiment, said ink jet printing apparatus further comprises pressure generating means for generating and applying a constant negative pressure on at least one ink cartridge of said ink jetting means, in order to prevent irregularities for a desired ink deposition rate during inkjet droplet formation and emission out of the printing head, therefore allowing an exact controlling and adjusting of the ink deposition rate on said ink jetting means, in particular during the successive layer printing.

More preferred, said negative pressure is adjustable to a lower negative value during stand-by operation of said ink jetting means, in order to avoid drawing back of ink compositions out of the printing head during stand-by mode. For example, the negative pressure may be adjusted from a value of −11 mbar during regular printing of said printing layers to a value of −8 mbar during stand-by operation.

In a further preferred embodiment, said pressure generating means is provided externally from said ink jetting means, this way allowing easy and inexpensive modification of conventional printing apparatuses.

According to another aspect of the present invention, an article of aluminium or aluminium alloys is provided, wherein said article is colored by above described method. Preferably, said article is colored with a printing resolution of 500 dpi to 3000 dpi. Application of the described method permits that the applied coloring of said article is preferably scratch-resistant and highly chemical-resistant and resistant to solvents and atmospheric corrosion and provides very high color fastness. According to a preferred application, said article is a plate or sheet or foil or exhibits any other spacial form, which may be used for signs, markings, labels, inscriptions, housings of metal boxes, even shaped 3-dimensional objects, outer and inner faces of buildings and furnitures, cylinder shaped articles, stone imitations, barcodes, watermarks and other security-relevant markings not visible by the human eye.

Figure 2:
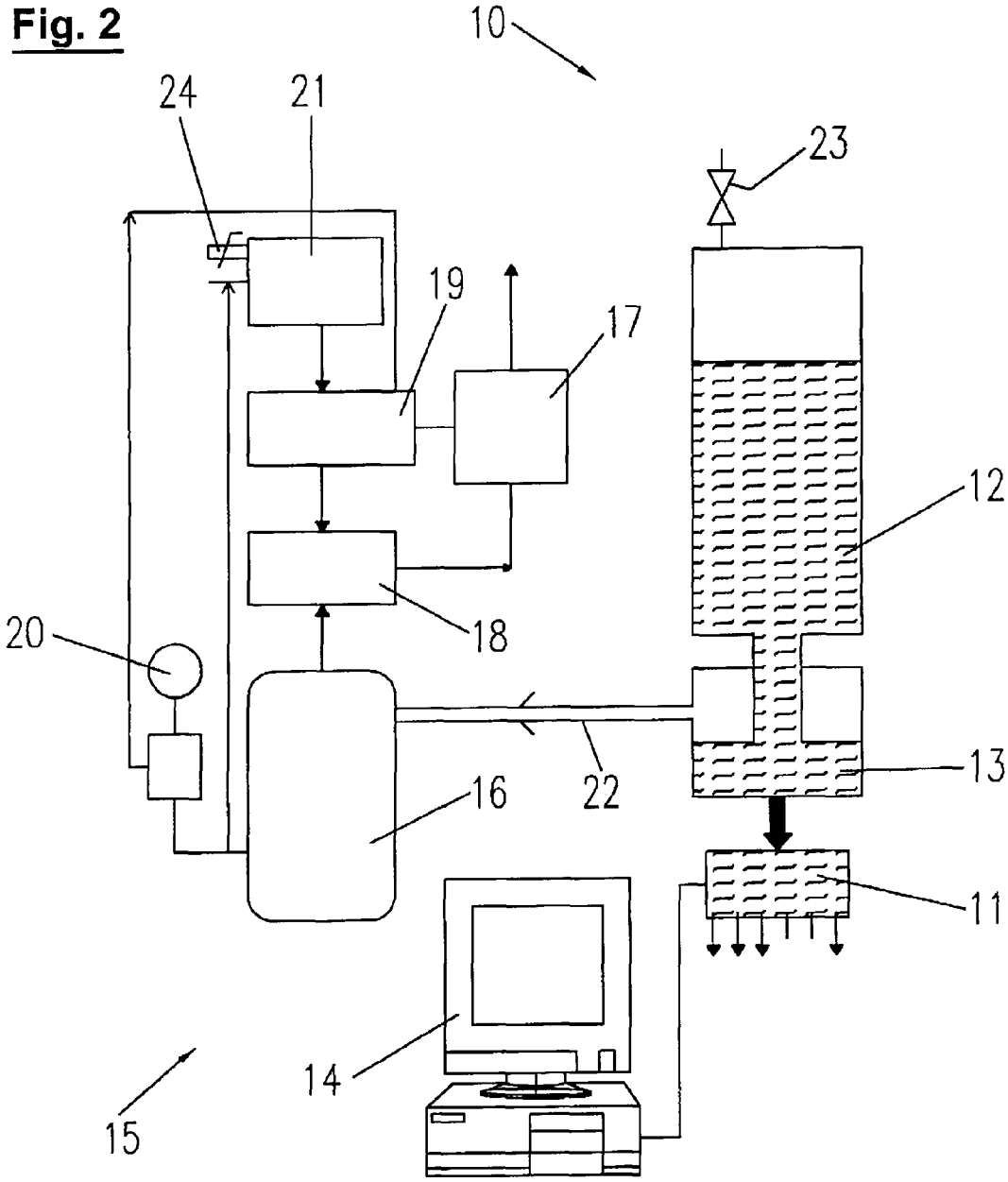

The invention will be described in more detail in the following description of preferred exemplary embodiments with reference to the accompanying drawings. In the drawings:

FIG. 1(*a*)-(*d*) is a sectional view which schematically illustrates a plate of aluminium or aluminiums alloys with a surface formed by an open pore oxide layer, that is colored by a method according to the invention; and FIG. 2 is a block diagram which illustrates an ink jet printing apparatus for coloring an article of aluminium or aluminiums alloys according to the invention.

FIG. 1(*a*) schematically depicts a metal plate 1 comprising a substrate 2 of aluminium or aluminiums alloys. An open pore oxide layer 3, e.g. produced by anodic oxidation, is arranged on the aluminium substrate 2 and forms the upper surface 4 of said metal plate 1. The depth of said open pore oxide layer 3 may be ca. 20 μm. The open pores 5 of said oxide layer 3 are only represented schematically, wherein a quantitative match with realistic dimensions is not intended.

In a first step, said metal plate 1 is mounted on a piezoelectric inkjet printing apparatus. Said inkjet printing apparatus comprises data processing means, in which pixel information of a printing picture are stored. Said pixel information comprises the position and color of each pixel point of the printing image to be printed on said metal plate 1. Moreover, information corresponding to the ink deposition rate for each pixel point to be printed on said surface 4 are stored in said data processing means. For instance, the ink deposition rate within one printing layer may vary depending on the color depth of the respective pixel point to be printed. In addition said information corresponding to the ink deposition rate is stored for a number of different printing layers to be printed successively on said surface 4, i.e. a bottom printing layer and five upper printing layers.

In a second step, the bottom printing layer is printed on said surface 4 according to the stored pixel information and the stored ink deposition rate of the bottom printing layer for each pixel point. FIG. 1(*b*) shows the metal plate 1 after printing of said bottom printing layer, wherein the deposited ink droplets 6 are diffused into the open pores 5. Thereby, a larger ink deposition rate has been applied on regions of said printing image with pixel points exhibiting a higher color depth and a lower ink deposition rate for pixel points exhibiting a lower color depth. Correspondingly, the open pores 5 are more filled by the diffused ink droplets 6 in regions of the printing image with a high color depth as compared to the regions with a lower color depth.

In a third step, the five upper printing layers are successively printed on said surface 4 according to said stored pixel information and the stored ink deposition rate of each of the upper printing layers. FIG. 1(*c*) shows the metal plate 1 after printing of the first upper printing layer, wherein the deposited ink droplets 6 are diffused into the open pores 5 on top of the diffused ink droplets 6 of the previously deposited bottom printing layer. Thereby, a decreased ink deposition rate with respect to the bottom printing layer has been applied on regions with pixel points exhibiting a higher color depth. However, the ink deposition rate for pixel points exhibiting a lower color depth has been kept at the same value as compared to the corresponding pixel points of the bottom printing layer.

FIG. 1(*d*) depicts the metal plate 1 after printing of the final upper printing layer. The open pores 5 at image regions with a higher color depth are more filled with diffused ink droplets 6 as compared to image regions with a lower color depth. Yet the effect of color bleeding is effectively avoided in the whole printing image.

Still to be remarked that the schematic representation of open pores 5 in FIGS. 1(*a*)-1(*d*) and their respective filling behavior only serves for illustrative purposes. In reality, however, neighboring open pores 5 will show an almost equal filling behavior by the deposited and diffused ink droplets 6 and variations in the filling of the open pores 5, e.g. due to a varying color depth of the respective pixels, will only be apparent on a larger scale of the printing image.

In a fourth step, the metal plate 1 is heated by means of bathing in demineralized water at a temperature of 98° C. and during a time segment of 60 minutes. Thereby, the open pores are closed after diffusion and inclusion of the deposited ink droplets 6.

FIG. 2 schematically illustrates an ink jet printing apparatus 10 according to the invention. The apparatus 10 comprises a piezoelectric printing head 11 that is connected to an ink reservoir 12 via an intermediate vessel 13 for automatic regulation of the ink flow. The ink droplet formation and ejection out of the printing head 11 is adjustable by electronic control means. A data processing unit 14 adapted for controlling the ink deposition rate is connected to the printing head 11. In the data processing unit 14 the pixel information of the printing image and information corresponding to the deposition rate for each pixel of each printing layer is stored. The ink reservoir 12 is rechargeable through a valve 23.

Additionally, pressure generating means 15 are provided to prevent irregularities during inkjet droplet formation and emission out of the piezoelectric printing head. The pressure generating means comprise a pressure reservoir 16 that is connected to the intermediate vessel 13 via a channel 22. The pressure is generated by means of a pump 17 that is connected to the pressure reservoir 16 via a valve 18 which is controllable by a control relay 19. For this purpose, the control relay 19 is connected with a pressure sensor 20 over a valve 21, which measures an actual value of the pressure inside the pressure reservoir 16. A demand value of the pressure can be set manually or electronically by switch 24 on valve 21. Thus, an effective pressure regulation is provided by pressure generating means 15 which works independently from the printing means 11, 12, 13 and allows for effective compensation of fluctuations of the atmospheric pressure acting on ink reservoir 12. Thereby, a highly uniform output of ink droplets from the printing head 11 is effectuated which allows for precise regulation of the ink deposition rate.

It should be understood that while certain variants of the present invention are illustrated and described herein, the invention is defined by the claims and is not to be limited to the specific embodiments described and shown. For example, although in the specific embodiment described herein six printing layers are applied also a higher or lower number of applied printing layers are conceivable. Furthermore, the invention is not limited to articles in the form of plates or sheets or foils but can be applied to any printable object of aluminium or aluminiums alloys comprising a surface formed by an open pore oxide layer.

The invention claimed is:

1. A printing method for coloring an article of aluminium or aluminium alloys, said article comprising a surface formed by an open pore oxide layer, including the steps of mounting said article on an inkjet printing apparatus;

printing a bottom printing layer on said surface according to predetermined pixel information and at a predetermined ink deposition rate for each pixel;

successively printing at least two upper printing layers on said surface, wherein on each upper printing layer the same pixel information is printed as on the bottom printing layer and the ink deposition rate for each pixel is adjusted if required; and heating said article only after said printing of the bottom printing layer and the at least two upper printing layers for fixing the resulting printing image on said surface.

2. The method of claim 1, wherein said adjusting of said ink deposition rate is carried out depending on characteristics of at least one of the following: said open pore oxide layer, said predetermined pixel information and ink compositions used in said inkjet printing apparatus.

3. The method of claim 1, wherein during printing of a number of pixels of at least one of said upper printing layers said ink deposition rate is adjusted to a decreased value with respect to corresponding pixels of said bottom printing layer.

4. The method of claim 3, wherein said ink deposition rate is adjusted to a decreased value during printing of said number of pixels of each of said upper printing layers with respect to corresponding pixels of the foregoing printed printing layer.

5. The method of claim 3, wherein said number of pixels represent a higher color depth as compared to remaining pixels of said predetermined pixel information.

6. The method of claim 5, wherein during printing of said remaining pixels of each of said upper printing layers said ink deposition rate is adjusted to the same value with respect to corresponding pixels of said bottom printing layer.

7. The method of claim 3, wherein the ink deposition rate during printing of said number of pixels of the final upper printing layer is decreased by at least 50% as compared to the ink deposition rate during printing of the corresponding pixels of the bottom printing layer.

8. The method of claim 1, wherein during printing of each pixel of each of said upper printing layers said ink deposition rate is adjusted to the same value with respect to corresponding pixels of said bottom printing layer.

9. The method of claim 1, wherein at least five upper printing layers are successively printed.

10. The method of claim 1, wherein said adjusting of said ink deposition rate comprises regulating the number and/or size of ink droplets emitted per pixel from said inkjet printing apparatus during printing of said printing layers.

11. The method of claim 1, wherein information corresponding to the ink deposition rate for each pixel for each printing layer is stored in a data processing unit.

12. The method of claim 1, wherein a constant negative pressure is applied on at least one ink cartridge of said inkjet printing apparatus during printing of said printing layers.

13. The method of claim 1, wherein said heating of said article is carried out at a temperature of 98° C. (371 K).

14. An article of aluminium or aluminium alloys, wherein said article includes a colored image printed by a method according to claim 1.

15. The article of claim 14, wherein said image is printed with a printing resolution of 500 dpi to 3000 dpi.

16. The article of claim 14, wherein the image on said article is scratch-resistant and highly chemical-resistant and resistant to solvents and atmospheric corrosion and provides very high light fastness.

17. The article of claim 14, wherein said article is a plate or sheet or foil or exhibits any other spacial form.

* * * * *